United States Patent [19]

Matthias

[11] Patent Number: 4,596,296

[45] Date of Patent: Jun. 24, 1986

[54] ROTARY DRILL BITS

[75] Inventor: Terry R. Matthias, Abbeydale, England

[73] Assignee: NL Petroleum Products Limited, Gloucestershire, England

[21] Appl. No.: 665,071

[22] Filed: Oct. 26, 1984

[30] Foreign Application Priority Data

Oct. 29, 1983 [GB] United Kingdom ..... 8328961

[51] Int. Cl.[4] ..... E21B 10/58; E21B 10/10; A46B 13/03

[52] U.S. Cl. ..... 175/379; 15/180; 175/340

[58] Field of Search ..... 175/379, 339, 340, 393, 175/331, 410; 15/180

[56] References Cited

U.S. PATENT DOCUMENTS

| | | | |
|---|---|---|---|
| 2,539,054 | 1/1951 | Breuer et al. | 15/180 |
| 2,619,666 | 12/1952 | Hayes et al. | 15/180 X |
| 3,243,832 | 4/1966 | Allen et al. | 15/180 |
| 3,384,191 | 5/1968 | Schumacher, Jr. et al. | 175/340 |
| 4,200,160 | 4/1980 | Newcomb | 175/340 |
| 4,341,273 | 7/1982 | Walker et al. | 175/339 |
| 4,363,367 | 12/1982 | Dixon et al. | 175/340 |
| 4,397,363 | 8/1983 | Fuller | 175/410 |
| 4,465,148 | 8/1984 | Morris et al. | 175/410 X |

FOREIGN PATENT DOCUMENTS

| | | | |
|---|---|---|---|
| 84/01186 | 3/1984 | PCT Int'l Appl. | 175/339 |

*Primary Examiner*—Stuart S. Levy
*Assistant Examiner*—Thomas R. Hannon
*Attorney, Agent, or Firm*—Browning, Bushman, Zamecki & Anderson

[57] ABSTRACT

A rotary drill bit, for use in subsurface formations, comprises a bit body, a passageway for drilling fluid within the body, communicating with nozzles in the external surface of the body, preform cutting elements mounted on the body for cutting or abrading the formation, and a number of elongate fences upstanding from the external surface of the body to control the flow of fluid from the nozzles and past cutting elements. Each fence is resiliently deformable, for example being in the form of a brush having metal bristles, so that, in use, the free elongate edge of the fence is urged resiliently into contact with the surface of the formation being cut or abraded by the cutting elements. Since each fence is resiliently deformable it will at all times firmly engage the formation to provide an effective seal, regardless of variations in depth of cut of the cutting elements.

15 Claims, 8 Drawing Figures

ROTARY DRILL BITS

BACKGROUND OF THE INVENTION

The invention relates to rotary drill bits and in particular to bits which are used to drill holes in rock or other subsurface formations, for example to extract oil, gas or water, or in mining.

The invention relates to drill bits of the kind comprising a bit body, for connection to a drill string, a passageway for drilling fluid within the body, which passageway communicates with one or more openings in an external surface of the body, cutting elements mounted on the external surface of the body for cutting or abrading the formation, and one or more elongate fences upstanding from the external surface of the body to control the flow of fluid from said opening or openings and past said elements. The low of fluid, controlled by said fences, serves to carry away cuttings and chippings removed from the formation by the cutting elements and also to cool the elements and the formation being drilled.

The cutting elements may be polycrystalline diamond compacts and may be arranged in rows alongside wall portions of channels or grooves provided in the surface of the bit. The fences are spaced from the cutting elements and may extend substantially parallel to the channels or grooves so as to control the flow of fluid along the blades and past the cutting elements.

It is desirable that the free edge of each fence remote from the bit surface should sealingly engage the formation so as to prevent flow of fluid across the fence, since this would reduce the flow of fluid past the cutting elements. However, the formation being drilled will usually be of varying hardness and this affects the quality of the seal between the fence and the formation. During drilling through formation of a fairly consistent hardness the free edge of the fence engaging the formation will be worn away to an extent depending on the depth of cut of the cutting elements and will form an effective seal with the formation. However, if the drill bit then enters formation of greater hardness, the depth of cut of the cutting elements will immediately be reduced with the effect that the fence will no longer sealingly engage the formation. Flow can then occur across the fence, leading to inefficient cooling and carrying away of cuttings and chippings. Furthermore, the rubbing engagement between the fences and the formation provides significant resistance to the rotation of the drill.

The present invention sets out to provide an improved form of rotary drill bit in which these disadvantages may be overcome.

SUMMARY OF THE INVENTION

According to the invention there is provided a rotary drill bit, for use in subsurface formations, comprising a bit body, a passageway for drilling fluid within the body, communicating with one or more openings in an external surface of the body, cutting elements mounted on the body for cutting or abrading the formation, and one or more elongate fences upstanding from the external surface of the body to control the flow of fluid from said opening or openings and past said cutting elements, each fence being resiliently deformable so that, in use, the free elongate edge thereof is urged resiliently into contact with the surface of the formation being cut or abraded by the cutting elements.

Since each fence is resiliently deformable it will at all times firmly engage the formation to provide an effective seal, regardless of variations in depth of cut of the cutting elements. An effective seal will thus be maintained regardless of variations in the hardness of the formation. Furthermore, since the fences are resiliently deformable this may reduce the resistance offered to rotation of the drill bit by frictional rubbing engagement between the fences and the formation.

Preferably each fence is separately formed from the bit body and is secured thereto. For example, each fence may be secured within an elongate channel in the surface of the bit body.

In a preferred embodiment each fence is in the form of an elongate brush having resilient bristles extending away from the surface of the bit body. The bristles may be formed from metal, such as stainless steel or any suitable metal alloy, or from synthetic plastics material. The bristles may be locked at one end thereof in an elongate channel-sectioned retaining element which is then secured within an elongate channel in the surface of the bit body.

The invention also provides a rotary drill bit, for use in subsurface formations, comprising a bit body, a passageway for drilling fluid within the body, communicating with one or more openings in an external surface of the body, cutting elements mounted on the body or cutting or abrading the formation, and one or more resilient rubbing pads each extending over an area of the body and comprising resilient bristles extending away from the surface of the bit body.

In any of the above arrangements each cutting element preferably includes, in known manner, a thin hard facing layer and a thicker, less hard, backing layer so that the cutting element is self-sharpening.

DETAILED DESCRIPTION OF THE PREFERRED EMBODIMENT

Figure 1:
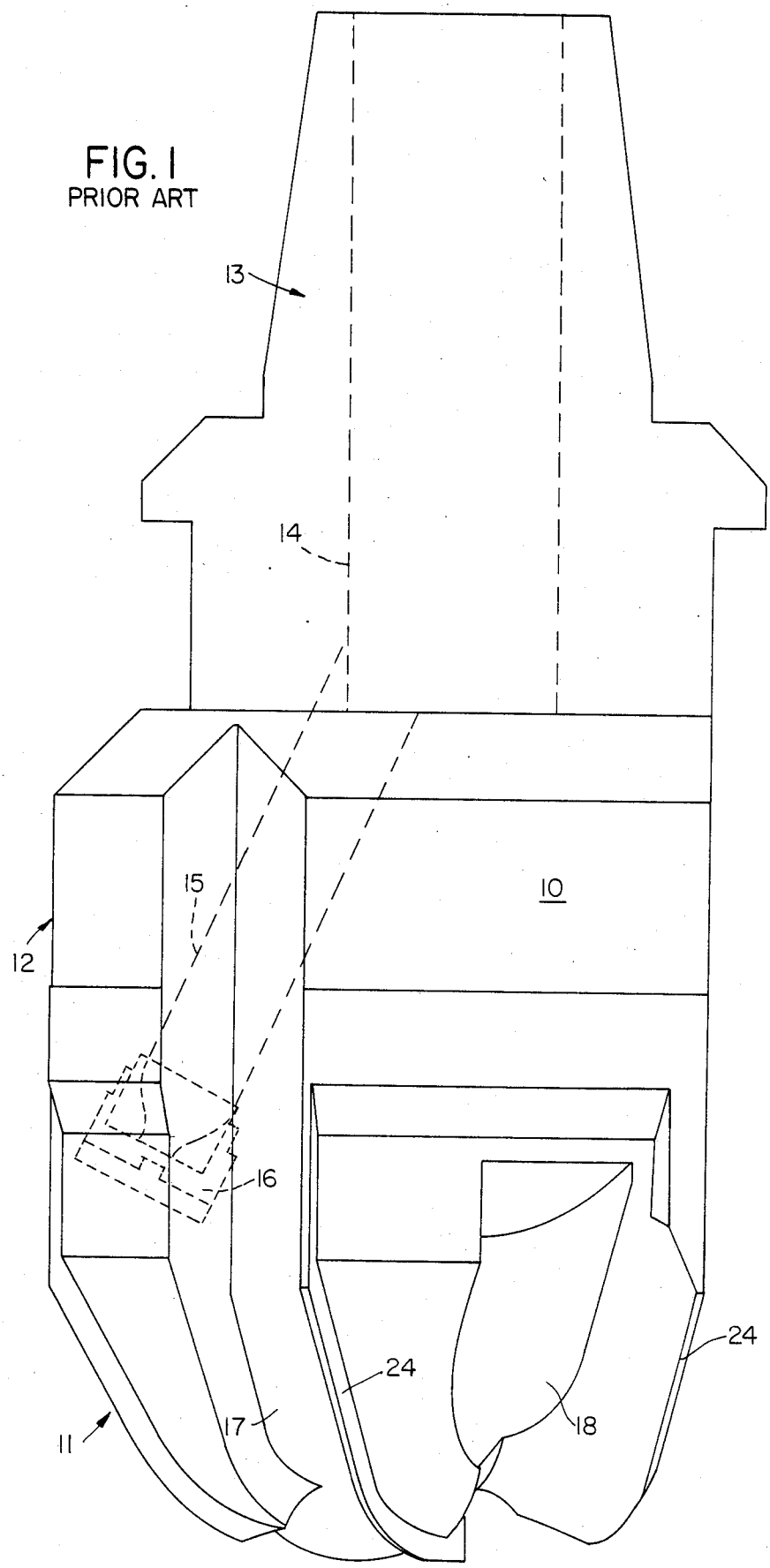
FIG. 1 PRIOR ART
FIG. 1 is a diagrammatic side elevation of a known drill bit of the basic kind to which the invention relates.

Referring to FIG. 1, the rotary drill bit body 10 comprises a leading bit end face 11, a gauge portion 12 and a rearward end portion 13 for connection to a drill string, not shown.

A central bore 14 extends through the end portion 13 and ends inside the bit. A number of passageways 15 of reduced diameter lead from the bore 14 to the periphery of the end face 11 where they communicate with outlet nozzles 16.

A number of grooves or channels 17 and 18 are formed in the surface of the bit, and extend outwardly and upwardly from the center of the leading bit end face. Six such channels are provided in the arrangement shown. Alternate channels 17 extend upwardly through the gauge portion 12 whereas the other channels 18 terminate adjacent the outer periphery of the bit end face 11. In the arrangement shown there are provided three outlet nozzles 16 each being disposed adjacent one of the shorter channels 18.

Figure 2:
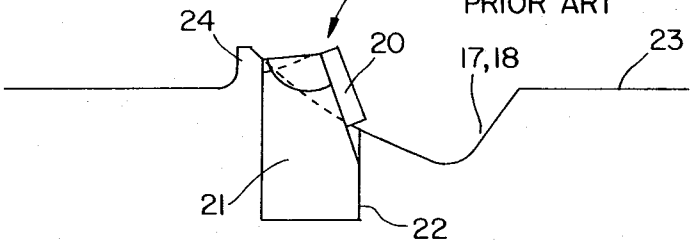
FIG. 2 PRIOR ART
FIG. 2 is a section through a cutting element showing a typical mounting thereof in a known form of bit.

FIG. 2 shows one of the channels 17 in cross-section. Spaced apart along one side of each channel are a plurality of cutting elements 19. (The cutting elements 19 are omitted from FIG. 1.)

Each cutting element 19 comprises, in known manner, a circular polycrystalline diamond compact 20 which is mounted on a stud 21 which is received within a circular socket 22 in the bit body. As best seen in FIG. 2, the compact 20 projects beyond the surface 23 of the bit body.

When the drilling bit is in use, drilling mud is pumped down the bore 14, flows along the passageways 15 and exits through the nozzles 16. As the bit is rotated the cutting elements 19 cut or abrade the formation, producing chippings. The drilling mud from the nozzles 16 flows along the channels 17 and 18 and past the cutting elements so as to clear away the chippings and cool the formation and the cutting elements. In the particular arrangement shown mud from each nozzle 16 first flows inwardly and downwardly along the channels 18 before returning outwardly and upwardly along the channels 17.

In order to control the flow of drilling mud along the channels, fences are provided along the rearward side of each row of cutting elements with respect to the direction of rotation of the bit. A known fence arrangement is shown in FIGS. 1 and 2, where a rigid elongate fence 24 is formed integrally with the bit body and projects from the surface thereof.

In use of the bit, the purpose of the fence 24 is to engage the surface of the formation to the rear of the cutting elements and to form a seal against the formation, thus containing the drilling mud within the channels 17, 18 so that it flows past the cutting elements. In practice, however, as previously explained, when drilling through formations of varying hardness the situation can arise where the fence does not firmly engage the surface of the formation and leakage from the channels 17, 18 across the fence can occur, to the detriment of the cooling and clearing efficiency of the mud flow.

Figure 3:
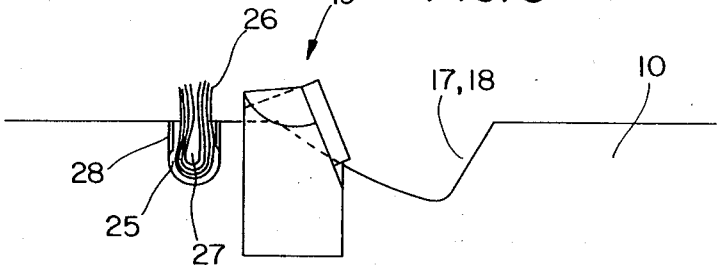
FIG. 3 is a similar view to FIG. 2 through a cutting element and its mounting in a drill bit according to the invention.
Figure 4:
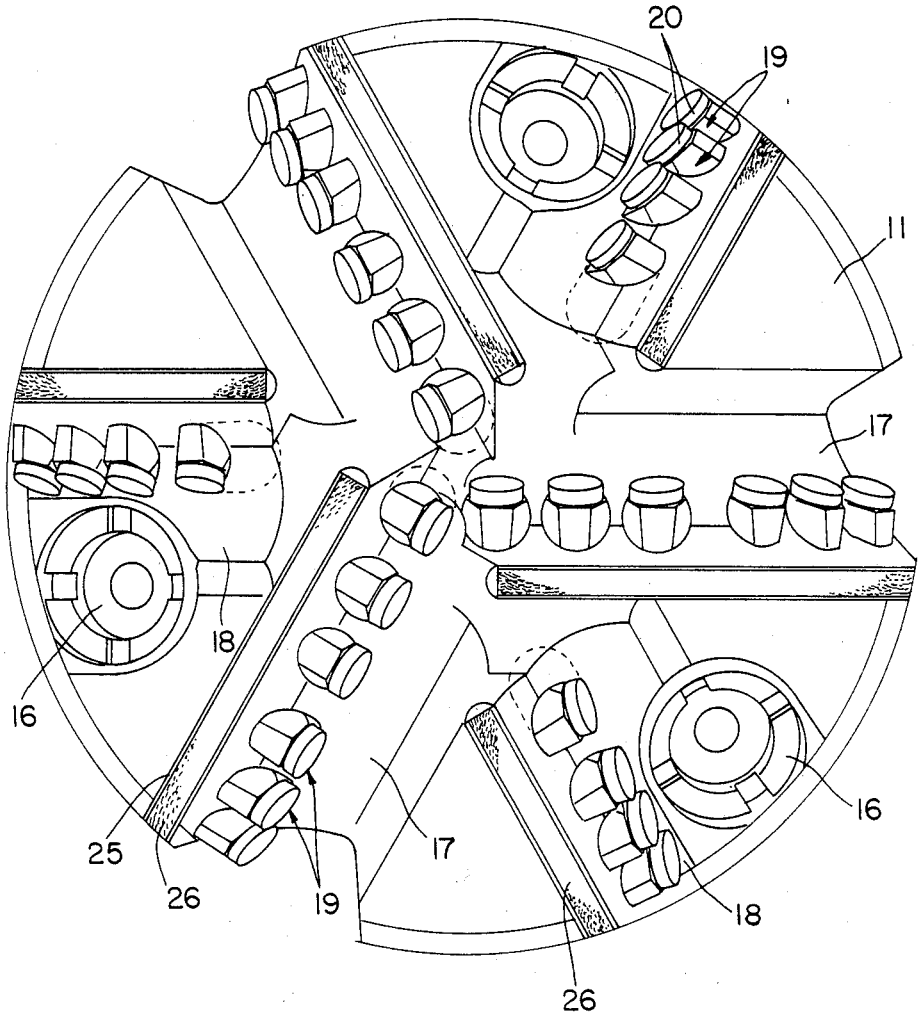
FIG. 4 is an end elevation of a drill bit according to the invention.

The present invention overcomes this problem by providing resiliently deformable fences and, in the embodiment shown in FIGS. 3 and 4, there are provided fences in the form of elongate brushes with metal bristles.

As best seen in FIG. 3, each fence comprises a generally channel-shaped metal element 25, the side walls of which are crimped on to stainless steel bristles 26 which are wrapped around a rod 27 extending the length of the channel. The brush is secured within a channel 28 formed in the surface of the bit body 10, for example by brazing.

Figure 5:
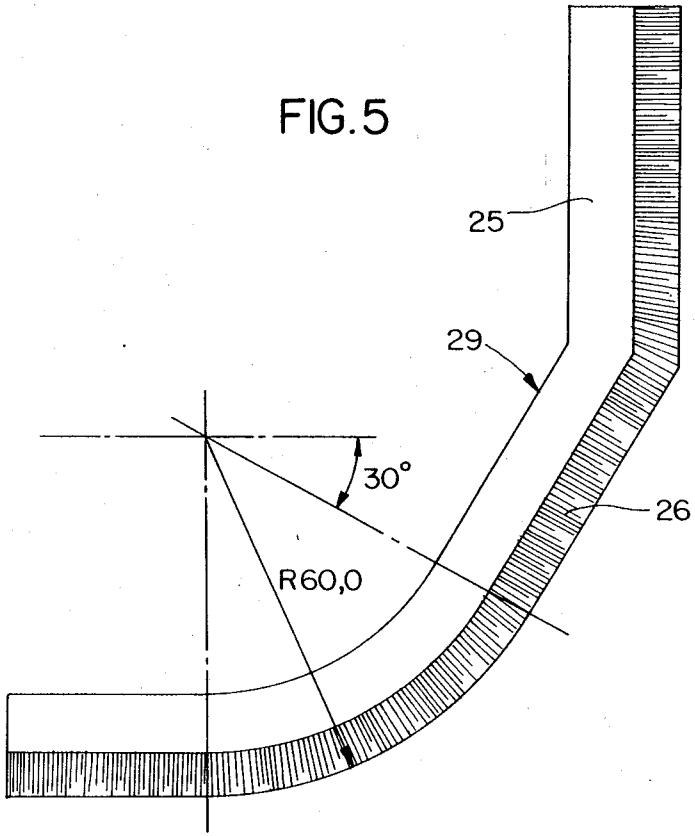
FIG. 5 is a side elevation of a brush element for use in the invention.

FIG. 5 is a side elevation of a brush element 29 of such a shape and size as to extend alongside one of the longer channels 17 in the bit body.

Since the bristles 26 of the brush element are resiliently deformable, they are urged by their resilience into engagement with the formation behind the cutting elements 19 and therefore provide an effective seal regardless of variations in the hardness of the formation and in the cutting depth of the cutting elements. The engagement of the bristles 26 with the formation may also provide less drag to oppose rotation of the bit than the known rigid fences of the kind shown in FIG. 2.

In use the brush elements will tend to clog with drilling debris, enhancing their sealing effect.

Figure 6:
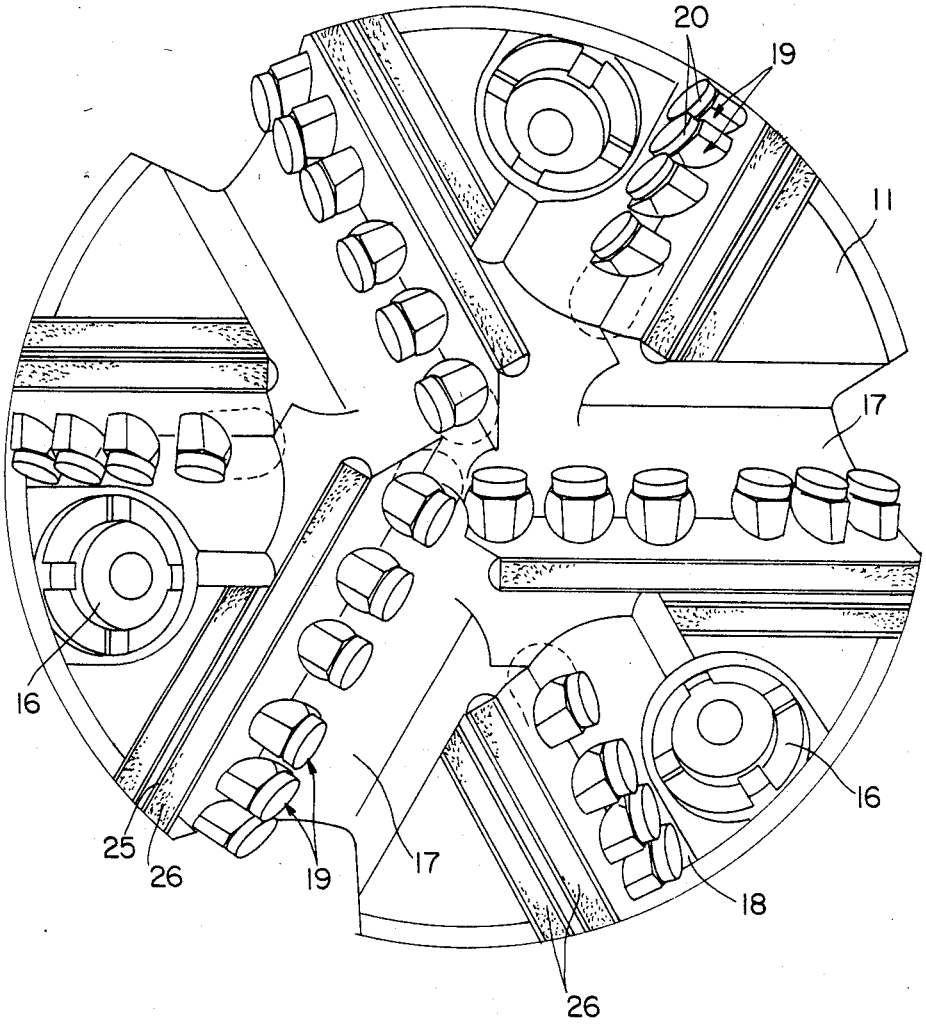
FIGS. 6 to 8 are similar views to FIG. 4 showing alternative embodiments of the invention.

The sealing effect may be enhanced by providing two elongate brushes in parallel behind each set of cutting elements, as shown in FIG. 6. This provides two pressure drops thus reducing the possibility of leakage past the brushes.

Figure 7:
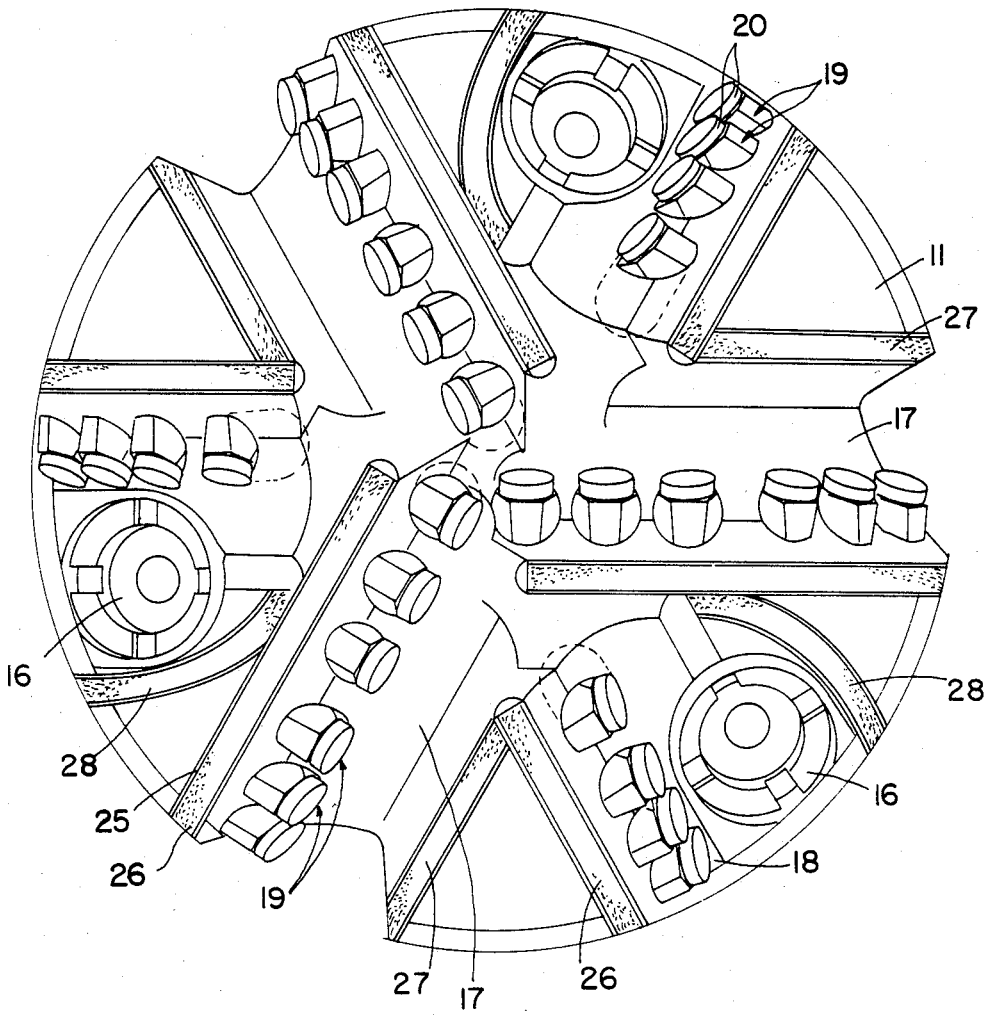

In the alternative arrangement shown in FIG. 7, an elongate brush element 27, similar in construction to the previously described elements 25, 26, is disposed along the opposite side of each channel 17 so as to act as a fence which restricts the flow of drilling fluid along the channel 17 and thus maintains the velocity of the fluid past the cutting elements. Curved elongate brush elements 28 may also be mounted along the sides of the nozzles 16 opposite the cutting elements 19, as is also shown in FIG. 7.

Figure 8:
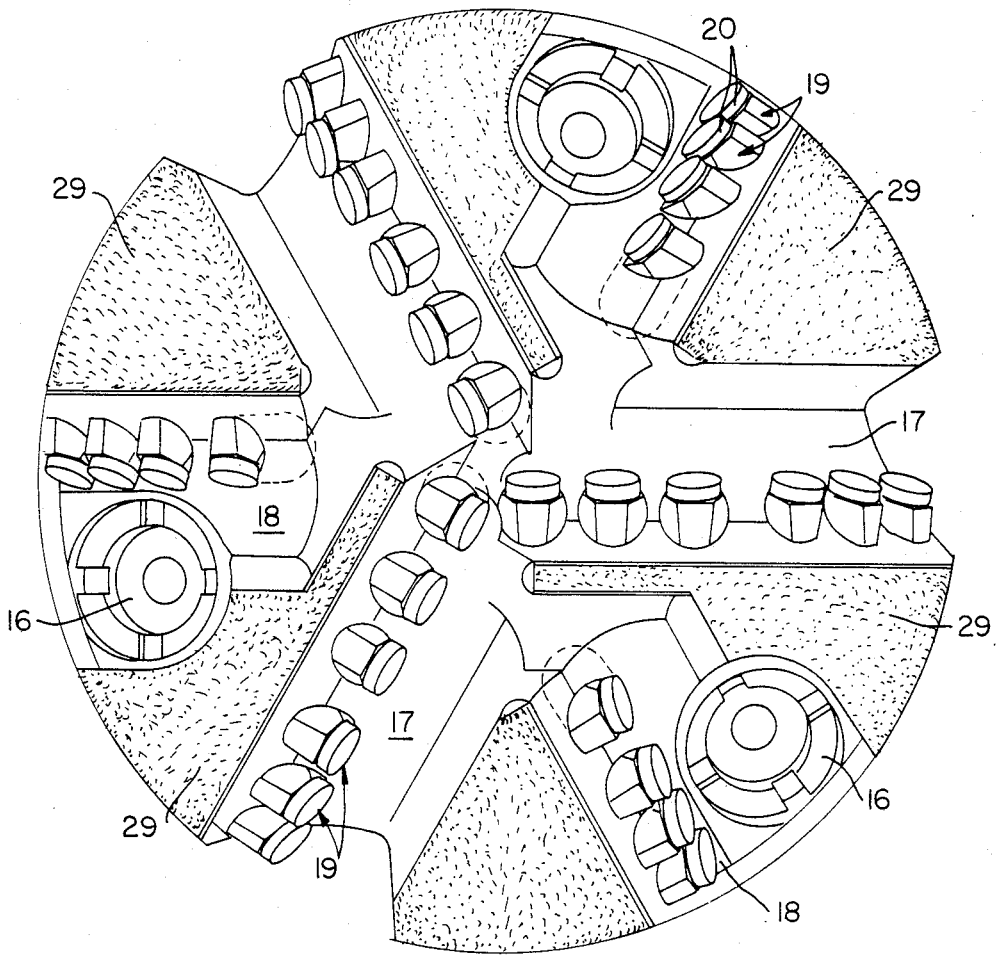

Similar control of the fluid flow and maintenance of the velocity of fluid flow past the cutting elements is also achieved by the alternative arrangement shown in FIG. 8 in which the elongate brush elements of FIG. 7 are replaced by larger brush elements which extend over larger areas of the surface of the bit body so as to provide shaped brush-like rubbing pads as indicated at 29 in FIG. 8. As well as providing sealing, these rubbing pads channel the drilling fluid from the nozzles 16 past the cutting elements.

As previously mentioned, the cutting elements are preferably of the self-sharpening type comprising a thin, hard facing layer and a thicker, less hard backing layer. Since the backing layer is less hard than the facing layer it tends, in use, to wear away more quickly than the facing layer to give a self-sharpening effect.

The arrangements described above with relation to FIGS. 3 to 8 are by way of example only, and it will be appreciated that alternative arrangements of the cutting elemenis, nozzles and fences may be provided. For example, it may not be necessary for the brush elements to extend as far towards the centre of the end face of the drill bit as shown in FIG. 4. The bristles may be formed from any suitable material, including synthetic plastics material, and other methods may be employed for anchoring the bristles to the bit body. The invention is also not limited to brush-like elements, but includes within its scope the use of strips of solid resilient material anchored to the bit body, such as strips of rubber, synthetic rubber or other synthetic resilient plastics material. The invention is also not limited to drill bits in which the cutting elements are polycrystalline diamond compacts, but may be applied to drill bits using natural or synthetic diamonds or any other type of cutting element.

I claim:

1. A rotary drill bit, for drilling wells in subsurface formations, comprising a bit body, a passageway for drilling fluids within the body, communicating with a number of openings in an external surface of the body, cutting elements mounted on the body for cutting or abrading the formation, and a number of elongate fences upstanding from the external surface of the body and positioned to control the flow of fluid from said openings and past said cutting elements, each fence comprising a plurality of resiliently deformable elements disposed adjacent one another in a direction across the width of the fence such that, in use, the free elongate edge of said fence is urged resiliently into contact with the surface of the formation being cut or abraded by the cutting elements.

2. A rotary drill bit according to claim 1, wherein each fence is separately formed from the bit body and is secured thereto.

3. A rotary drill bit according to claim 2, wherein each fence is secured within an elongate channel in the surface of the bit body.

4. A rotary drill bit according to claim 1 wherein a plurality of the resiliently deformable elements in each of said fences are disposed adjacent one another in a direction along the length of the fence.

5. A rotary drill bit according to claim 4 wherein the lengths of said fences extend generally radially, and the widths of said fences extend generally circumferentially with respect to said bit body.

6. A rotary drill bit according to claim 4, wherein each fence is in the form of an elongate brush having resilient bristles extending away from the surface of the bit body.

7. A rotary drill bit according to claim 6, wherein the bristles are formed from metal.

8. A rotary drill bit according to claim 7, wherein the bristles are formed from stainless steel.

9. A rotary drill bit according to claim 6, wherein the bristles are locked at one end thereof in an elongate channel-sectioned retaining element which is then secured within an elongate channel in the surface of the bit body.

10. A rotary drill bit according to claim 9, wherein the bristles are generally U-shaped and are wrapped around an elongate element extending along the interior of the channel-sectioned retaining element, the side walls of the element being crimped on to the bristles.

11. A rotary drill bit according to claim 1, wherein the bit body is formed with a number of rows of said cutting elements extending outwardly away from the central axis of the bit body, a resiliently deformable fence extending generally along each row and being spaced rearwardly of the cutting elements with respect to the normal direction of rotation of the drill bit.

12. A rotary drill bit according to claim 11, wherein two spaced, generally parallel resiliently deformable fences are disposed rearwardly of each row of cutting elements.

13. A rotary drill bit according to claim 1, wherein there are provided, at the surface of the bit body, a plurality of channels extending outwardly away from the central axis of the bit body, for controlling the flow of drilling fluid past the cutting elements, said resiliently deformable fences being located generally along the sides of said channels.

14. A rotary drill bit according to claim 1, wherein each cutting element includes a thin, hard facing layer and a thicker, less hard, backing layer so that the cutting element is self-sharpening.

15. A rotary drill bit, for drilling wells in subsurface formations, comprising a bit body, a passageway for drilling fluid within the body, communicating with a number of openings in an external surface of the body, cutting elements mounted on the body for cutting or abrading the formation, and a number of resilient rubbing pads each extending over an area of the body and comprising resilient bristles extending away from the surface of the bit body.

* * * * *